US011633741B2

(12) United States Patent
Kabaha et al.

(10) Patent No.: US 11,633,741 B2
(45) Date of Patent: Apr. 25, 2023

(54) SLIDE CHAMBER

(71) Applicant: Miltenyi Biotec B.V. & Co. KG, Bergisch Gladbach (DE)

(72) Inventors: Eiad Kabaha, Cologne (DE); Ralf-Peter Peters, Bergisch Gladbach (DE); Jan Keseberg, Altendorn (DE); Andreas Bosio, Cologne (DE)

(73) Assignee: Miltenyi Biotec B.V. & Co. KG, Bergisch Gladbach (DE)

( * ) Notice: Subject to any disclaimer, the term of this patent is extended or adjusted under 35 U.S.C. 154(b) by 37 days.

(21) Appl. No.: 16/794,937

(22) Filed: Feb. 19, 2020

(65) Prior Publication Data

US 2020/0298241 A1 Sep. 24, 2020

(30) Foreign Application Priority Data

Mar. 19, 2019 (EP) ..... 19163639

(51) Int. Cl.
*B01L 9/00* (2006.01)

(52) U.S. Cl.
CPC ..... *B01L 9/52* (2013.01); *B01L 2200/0689* (2013.01); *B01L 2200/087* (2013.01); *B01L 2300/046* (2013.01); *B01L 2300/12* (2013.01)

(58) Field of Classification Search
CPC ..... B01L 9/52; B01L 2200/0689; B01L 2200/087; B01L 2300/046; B01L 2300/12; B01L 2300/041; B01L 2200/025; B01L 2200/026; B01L 2300/045; B01L 2300/047; B01L 2300/0822; B01L 3/5085; G01N 21/03
USPC ..... 436/174
See application file for complete search history.

(56) References Cited

U.S. PATENT DOCUMENTS

| | | | | |
|---|---|---|---|---|
| 3,745,091 | A * | 7/1973 | McCormick | B01L 3/5085 435/305.3 |
| 3,883,398 | A | 5/1975 | Ono | |
| 7,741,045 | B2 | 6/2010 | Gerdes et al. | |
| 2002/0009390 | A1 * | 1/2002 | Lappe | B01L 3/502 436/165 |

(Continued)

FOREIGN PATENT DOCUMENTS

| | | |
|---|---|---|
| DE | 10 2015 113934 | 2/2017 |
| EP | 0014007 A1 | 1/1982 |

(Continued)

*Primary Examiner* — Benjamin R Whatley
*Assistant Examiner* — Jacqueline Brazin
(74) *Attorney, Agent, or Firm* — Jaquelin Spong

(57) ABSTRACT

The invention is directed to a slide chamber comprising a top member (10), a fluidic seal (20), a transparent closure member (30) and base member (40) wherein the top member (10) is provided with at least one examination chamber (11) and a plurality of openings (12) positioned at two sides of the cover member outside of the examination chamber (11); and the base member (40) is provided with interconnecting means (41) complementary to the openings (12) of the top member characterized in that the interconnecting means (41) of the base member (40) and the openings (12) of the top member (10) are configured to mechanically interlock with each other by lateral movement thereby pressing the top member (10) against the transparent closure (30) member in a water-tight manner.

17 Claims, 8 Drawing Sheets

(56) References Cited

U.S. PATENT DOCUMENTS

| | | | | |
|---|---|---|---|---|
| 2003/0236497 | A1* | 12/2003 | Fremming | A61B 5/150519 604/126 |
| 2004/0209349 | A1 | 10/2004 | Miltenyi et al. | |
| 2006/0216211 | A1* | 9/2006 | Liebel | B01L 9/52 422/400 |
| 2007/0164032 | A1* | 7/2007 | Cronin | B65D 43/12 220/345.1 |
| 2010/0151511 | A1* | 6/2010 | Greenizen | B01L 3/5085 435/40.5 |
| 2013/0156644 | A1* | 6/2013 | Lee | G01N 29/222 422/69 |
| 2017/0014824 | A1 | 1/2017 | Boyd | |

FOREIGN PATENT DOCUMENTS

| | | | |
|---|---|---|---|
| EP | 0210071 | B1 | 9/1998 |
| EP | 1222462 | B1 | 12/2004 |
| GB | 2127577 | | 10/1983 |
| WO | WO2018001767 | A1 | 1/2018 |

* cited by examiner 12
14
16
18
20
22
24
26
28
30
32
34
36
38
40
42
44
46
48
50
52
54
56
58
60
62
64
66
68
70
72
74
76
78
80
82
84
86
88
90
92

SLIDE CHAMBER

CROSS REFERENCE TO RELATED APPLICATIONS

This U.S. patent application claims priority to European patent application serial no. EP 19163639, filed Mar. 19, 2019 This prior application is incorporated by reference in its entirety.

STATEMENT REGARDING FEDERALLY SPONSORED RESEARCH

Not applicable.

STATEMENT REGARDING MICROFICHE APPENDIX

Not applicable.

BACKGROUND

This invention relates to a slide chamber i.e. a device providing wells attached to a microscope inspection slide for analyzing biological specimens.

In immunofluorescence analysis, fluorescent dyes conjugated to one or more antigen recognizing moieties like antibodies are used for specific detection and isolation of target cells. To this end, a vast number of antibodies, fluorescent dyes, flow cytometers, flow sorters and fluorescence microscopes has been developed.

One technique of immunofluorescence analysis makes use of sequential elimination of the fluorescence signal and re-staining of the same biological specimen, thus allowing detection of a plurality of targets (antigens) on the biological specimen resulting in much higher multiplexing potential compared to standard procedures using simultaneous labeling and detection. For example, U.S. Pat. No. 7,741,045 B2, EP 0810 428 B1 or DE10143757 disclose elimination of the fluorescence signal by photo- or chemical destruction of the conjugated fluorescent moieties.

The staining and de-staining processes require devices to hold or support the biological specimen in a way that optical imaging is possible and into which fluid reagents may be introduced or withdrawn. For example, WO2018001767A1 discloses a multilevel disposable cartridge, which is configured to accept a biological sample on a transparent support and is provided with a plurality of fluid wells or reservoirs to hold a plurality of fluid reagents.

On the other hand, most staining experiments for biological specimen like pathology examinations are performed on standard microscope inspection slides known for decades. Accordingly, many devices comprising wells or reservoirs for fluid reagents, attached to a standard microscope inspection slide have been developed. So called "chambered slides" are for example disclosed in EP0014007A1, EP0210071B1, EP1222462B1, GB2127577A, U.S. Pat. No. 3,883,398 and DE2157150. The devices disclosed herein comprise a plastic structure providing reservoirs or wells either glued or attached by mechanical means like clips or clamps to a microscope inspection slide.

However, the known chambered slides suffer from leakage and/or can not be disassembled to store the microscope inspection slide after use with the sample only. Accordingly, there is a need for chambered slides which can be easily assembled/disassembled without the danger of leaking.

SUMMARY

Object of the invention is a slide chamber comprising a top member (10), a fluidic seal (20), a transparent closure member (30) and base member (40) wherein the top member (10) is provided with at least one (1) examination chamber (11) and a plurality of openings (12) positioned at two sides of the cover member outside of the examination chamber (11); and the base member (40) is provided with interconnecting means (41) complementary to the openings (12) of the top member wherein the interconnecting means (41) of the base member (40) and the openings (12) of the top member (10) are configured to mechanically interlock with each other by lateral movement thereby pressing the top member (10) against the transparent closure (30) member, preferable in a water-tight manner.

Further object of the invention is a process for preparing at least one biological tissue in a slide chamber as defined in the claims for optical examination characterized by placing the at least one biological tissue on a transparent closure member (30), combining the top member (10) and the transparent closure member (30) with an interleaved fluidic seal (20); attaching the base member (40) so that the interconnecting means (41) of the base member (40) are inserted into the openings (12) of the top member (10) and closing the slide chamber by lateral movement of the top member (10) against the transparent closure member (30), preferable in a water-tight manner.

BRIEF DESCRIPTION OF THE DRAWINGS

Various exemplary details are described with reference to the following figures, wherein:

FIG. 3 shows a first step in the interconnection; FIG. 4 shows a next step in the interconnection; FIG. 5 shows a next step in the interconnection; FIG. 6 shows a next step in the interconnection; FIG. 7 shows a variant in the interconnection; and FIG. 8 shows another embodiment of the interconnection.

It should be understood that the drawings are not necessarily to scale, and that like numbers may refer to like features.

DETAILED DESCRIPTION

Figure 1:
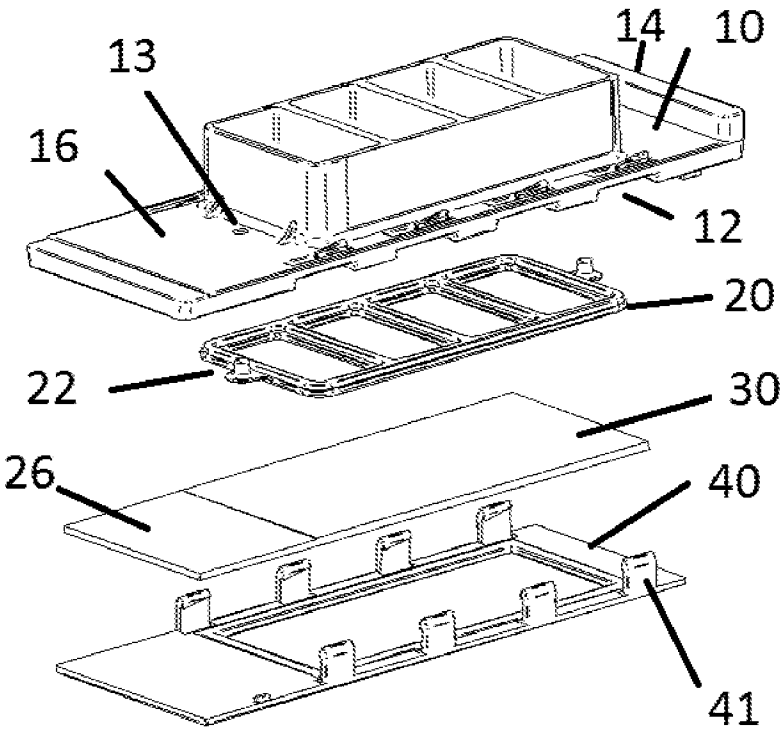
FIG. 1 is an exploded perspective view of the slide chamber

The slide chamber as disclosed herein is especially useful for optical examination under wet conditions, i.e. under presence of a fluid, for at least one biological tissue located inside in one or more examination chambers (11). The term "optical examination" refers to any examination method known in biology or medicine involving a biological sample and a fluid containing at least one reactant. This term includes visible light microcopy, fluorescence microscopy and staining with or without antibody conjugated dyes. Since the slide chamber according to the invention may comprise one (1) or more, like 2, 4, or even 8 examination chambers and fluids can easily introduced and removed from these, the slide chamber of the invention can be used in a multi-staining and de-staining process, for example as disclosed in U.S. Pat. No. 7,741,045 B2, EP 0810 428 B1, DE10143757, EP3037821A1, EP2725359B1 or WO2017144338A1. It should be noted that the terms "sample", "biological tissue" or "biological sample" are used synonymous hereinafter.

After the examination is performed, the slide chamber of the invention may be disassembled, so that the sample located on the transparent closure member (30) can be retrieved and optionally stored for further examination. Accordingly, the interconnecting means (41) and the openings (12) are configured to be mechanically disengaged from each other by lateral movement of the of the base member (40) against the top member (10).

Essential for optical examination of a sample covered or at least wetted by a fluid is the water-tight assembly of the parts (members) of the slide chamber. This requires a sufficient pressure on the fluidic seal (20) combining the top member (10) and the transparent closure member (30).

To this end, the interconnecting means (41) of the base member (40) and the openings (12) of the top member (10) are preferably configured as bayonetted joint. As shown in FIGS. 3 to 8, the interconnecting means (41) of the base member (40) and the openings (12) of the top member (10) are provided with means configured to mechanically interconnect with each other. Such means can be for example one or more notches and a corresponding noses (42*a*) and (42*b*) or a similar groove-and-spring design.

Preferably, the interconnecting means (41) of the base member (40) and the openings (12) are configured as to create an increasing pressure (force) between the base member (40) and the top member (10) during the closing process, i.e. during lateral movement of the of the base member (40) against the top member (10).

Figure 3:
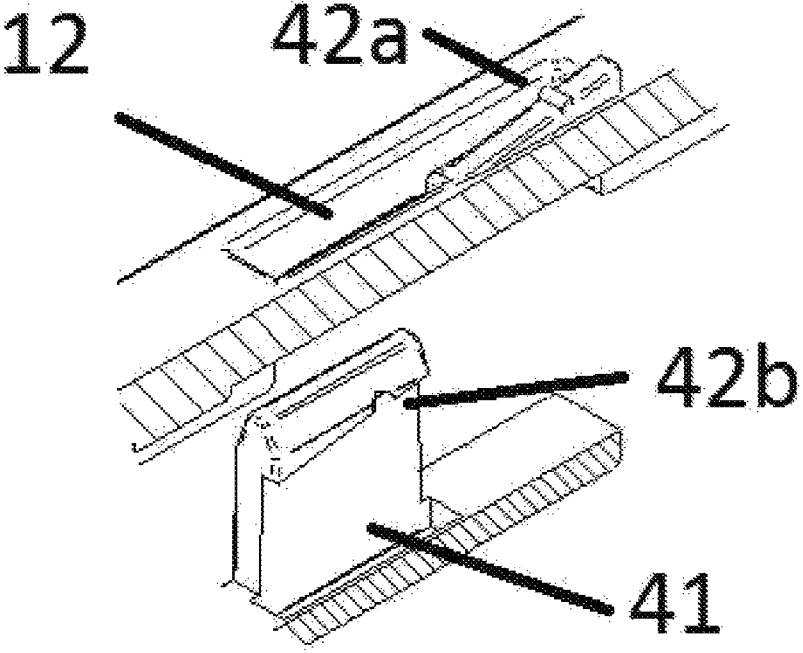
FIGS. 3 to 8 shows the closing mechanism of the slide chamber i.e. how the interconnecting means (41) and the openings (12) mechanically interlock with each other by lateral movement of the base member (40) against the top member (10) by means (42*a*) and (42*b*).
Figure 4:
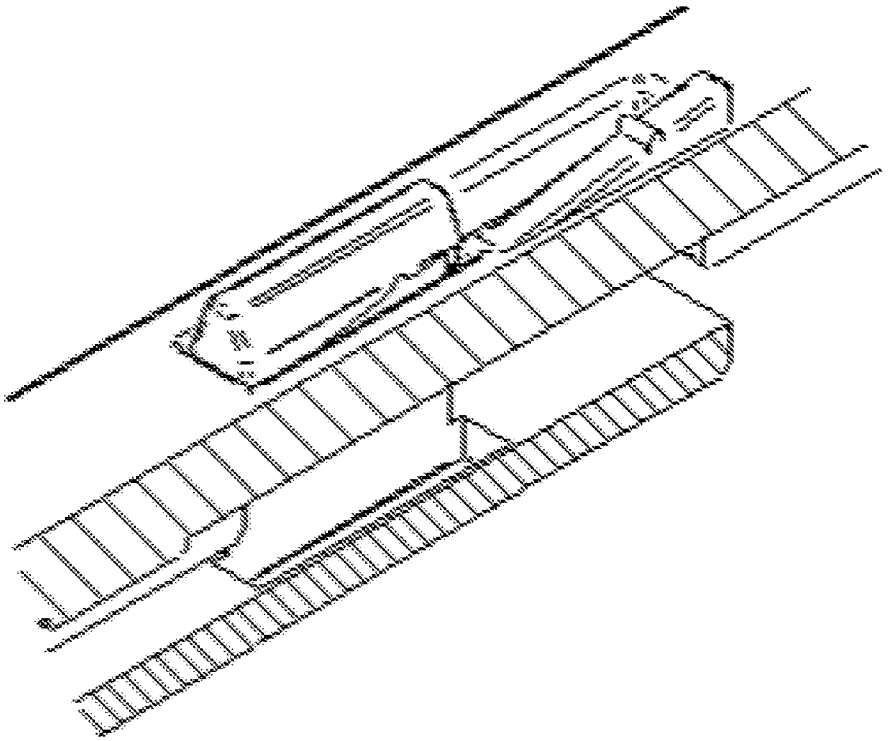
Figure 5:
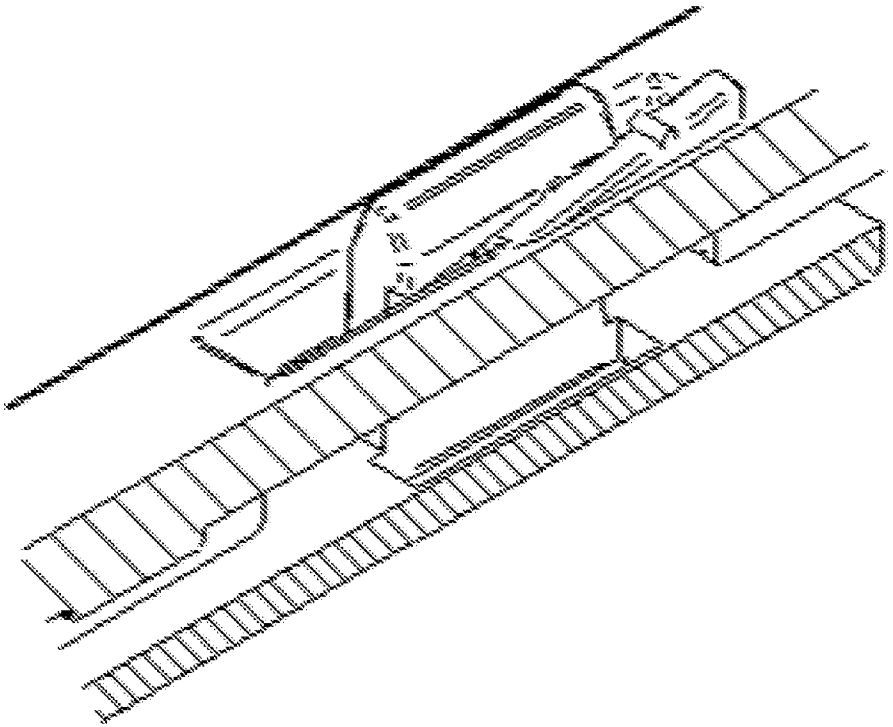
Figure 6:
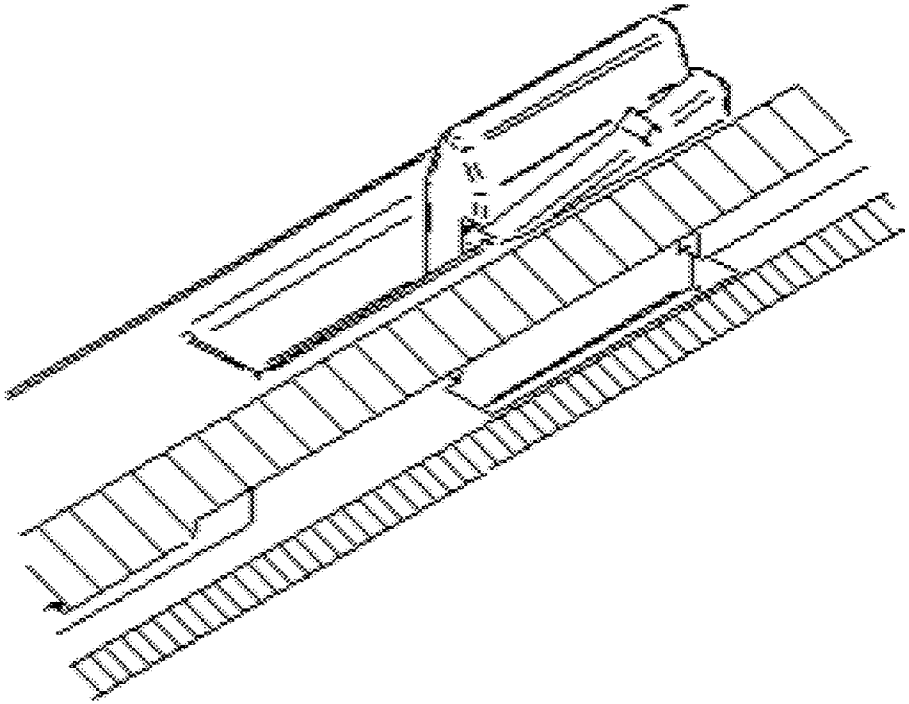
Figure 7:
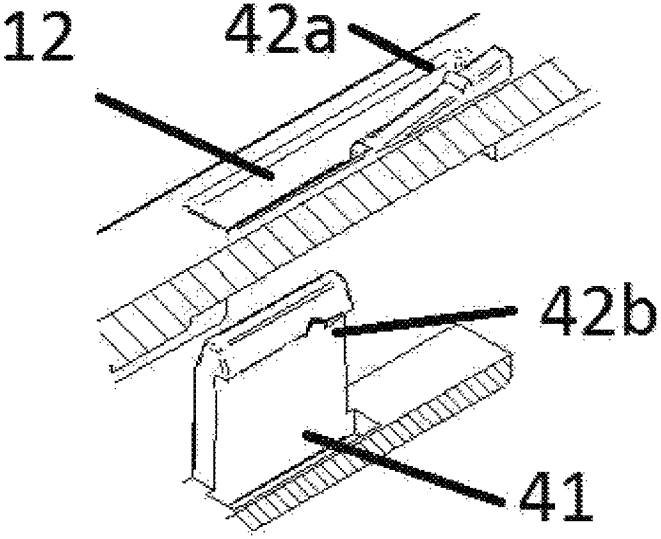

In a first variant, increasing pressure (force) between the base member (40) and the top member (10) is achieved by providing the interconnecting means (41) of the base member (40) and the openings (12) with a tilted shape as shown in FIG. 3. In another variant, either the interconnecting means (41) of the base member (40) or the openings (12) are provided with a tilted shape as shown in FIG. 7.

Figure 8:
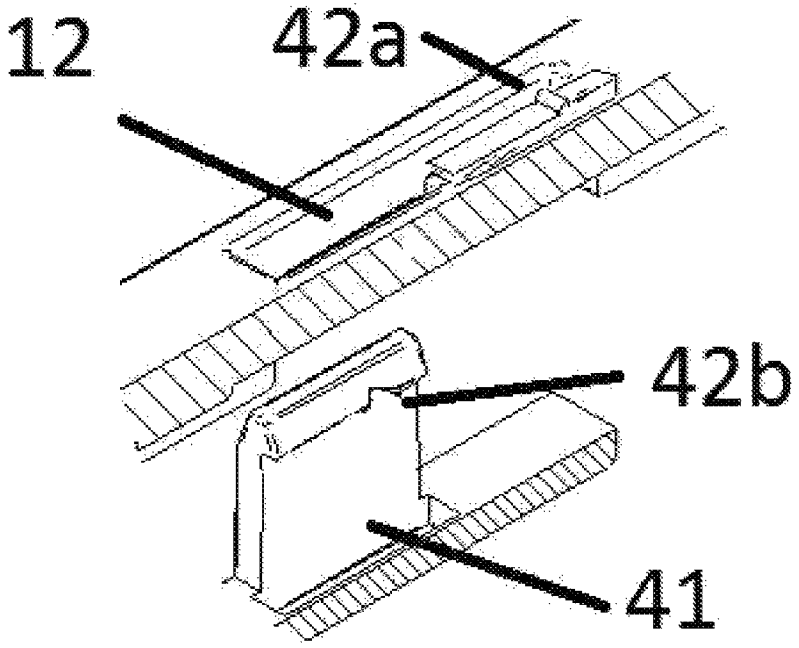

In a further embodiment of the invention, the increasing pressure (force) between the base member (40) top member (10) is provided by the fluidic seal (20), which is slightly compressed during the closing process, i.e. during lateral movement of the of the base member (40) against the top member (10). In this embodiment, it is not necessary to provide the interconnecting means (41) of the base member (40) or the openings (12) with a tilted shape. This embodiment is shown in FIG. 8.

In a further embodiment of the invention, the top member (10) is provided with a recess for the fluidic seal (20). The recess for the fluidic seal (20) may be provided only around or at the outer circumference of the examination chambers. In a variant thereof, if a plurality of examination chambers is used, the recess and the fluidic seal (20) may be provided around or at the position of each examination chamber. Of course, the shape of the fluidic seal (20) determines the shape of the recess and preferable, the fluidic seal (20) seals off each examination chamber as for example shown in FIG. 1 and the recess has the same shape as the seal.

The fluidic seal (20) and the top member (10) may be provided with one or more mounting means like the projection (22) and the recess/through-hole (13) as shown in FIG. 1. The fluidic seal (20) may be manufactured from any rubber material known in the art, like silicone rubber.

In best case, a biological tissue is placed within one examination chamber, i.e. the area of the examination chamber and the seal is larger than the sample. However, it might occur that the biological tissue is placed within at least two examination chambers, i.e. either by bad positioning of the sample or if the sample is too large for one examination chamber. In this case, the seal should nonetheless prevent leaking of fluid from one examination chamber to another and/or out of an examination chamber. In other words, the fluidic seal should not be too hard or to soft. Preferred materials for the fluidic seal (20) have a Shore A hardness of 20-50.

For easy positioning of the transparent closure member (30) i.e. of the sample against the examination chambers, the top member (10) is preferable provided with means for holding the transparent closure member (30) as shown by (14) in FIG. 1. The holder may be a wall or a ridge having at least the same height as the thickness of the transparent closure member (30) and may be provided at all edges of the top member. In a preferred variant, the means for holding the transparent closure member (30) are configured to allow movement of the transparent closure member (30) against the top member (10) before finally assembling the slide chamber. For example, if the transparent closure member (30) is a standard microscopic slide glass, the means for holding the transparent closure member (30) are configured to allow lateral movement of the microscopic slide glass of +−15 mm in longitudinal direction. Again, such movement or adjustment of position is only possible before assembling the slide chamber and not when the interconnecting means (41) and the openings (12) are mechanically interlocked.

To aid assembly and disassembly of the slide chamber, the top member (10) may be provided with at least one grip for example as shown with (14) in FIG. 1. Further, since many microscopic slide glasses have an writable region (26 in FIG. 1) at one end for information purposes, top member (10) may be provided with at least one transparent region at one end (16 in FIG. 1) to allow visibility of the writable region of the microscopic slide glass during examination.

Figure 2:
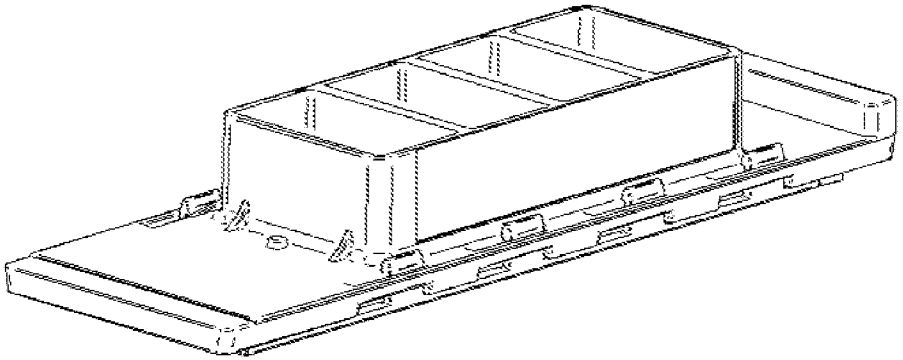
FIG. 2 is an side view of the assembled slide chamber

Optical examination methods often require adding fluids containing appropriate reactants like dyes to the sample. The slide chamber of the invention is therefore provided with one or more examination chambers (as shown in FIGS. 1 and 2), which may be provided by walls attached to or emerging from the upper surface of the top member (10). Usually, the examination chambers have a volume of 0.1 to 5 ml. If more than one examination chamber is provided, they may have the same or a different volume.

In general, "open" examination chambers are preferred. However, in a variant of the invention the examination chambers are provided with a top cover optionally having at least one orifice to allow input and removal of fluids and radiation.

The base member (40) and the top member (10) can be manufactured from PET, PS, PE, PP or COP for example by injection-moulding. Preferable, the top member (10) is transparent to visible and/or UV radiation and has a low fluorescent background, which can be achieved by using COP for manufacturing.

USE OF THE INVENTION

The slide chamber according to the invention may be used in all application of biology or medicine where cells or biological tissue is subjected to optical examination under wet conditions. This includes microscopy, in situ cultivation of cells during microscopy, life cell microscopy or ultrasonic microscopy, preferable involving a process comprising staining, incubation, washing and removal of stain on the biological sample While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. Accordingly, the exemplary implementations set forth above, are intended to be illustrative, not limiting.

What is claimed is:

1. A slide chamber comprising a top member (10), a fluidic seal (20), a transparent closure member (30) and base member (40) wherein the top member (10) is provided with at least one examination chamber (11) and a plurality of openings (12) positioned at two sides of the cover member outside of the examination chamber (11); and the base member (40) is provided with interconnecting means (41) complementary to the openings (12) of the top member characterized in that the interconnecting means (41) of the base member (40) and the openings (12) of the top member (10) are configured to mechanically interlock with each other by lateral movement the base member and the transparent closure member move laterally from an unsealed to a sealed, non-leaking position using the interconnecting means, thereby pressing the top member (10) against the transparent closure (30) member in the locked position wherein the interconnecting means (41) is configured as a bayonetted joint.

2. The slide chamber according to claim 1, characterized in that the interconnecting means (41) and the openings (12) are configured to be mechanically disengaged from each other by lateral movement of the base member (40) against the top member (10).

3. The slide chamber according to claim 1, characterized in that the top member (10) is provided with a recess for the fluidic seal (20).

4. The slide chamber according to claim 1, characterized in that the top member (10) is provided with means for holding the transparent closure member (30).

5. The slide chamber according to claim 4, characterized in that means for holding the transparent closure member (30) are configured to allow movement of the transparent closure member (30) against the top member (10).

6. The slide chamber according to claim 4, characterized in that the means for holding the transparent closure member (30) are configured to allow movement of the transparent closure member (30) against the top member (10) before finally assembling the slide chamber.

7. The slide chamber according to claim 1, characterized in that the top member (10) is provided with at least one grip (14).

8. The slide chamber according to claim 1, characterized in that the interconnecting means (41) of the base member (40) and the openings (12) of the top member (10) are configured as bayonetted joint.

9. The slide chamber according to claim 1, characterized in that the fluidic seal (20) has a Shore A hardness of 20-50.

10. The slide chamber according to claim 1, characterized in that the base member (40) and the top member (10) is manufactured from PET, PS, PE, PP or COP.

11. The slide chamber according to claim 1, characterized in that the transparent closure member (30) is a microscopic slide glass.

12. The slide chamber according to claim 1, characterized in that the examination chambers are provided by walls attached to or emerging from the upper surface of the top member (10).

13. The slide chamber according to claim 1, characterized in that the examination chambers are provided with a top cover.

14. A process for preparing at least one biological tissue in the slide chamber according to any of the claims 1 to 13 for optical examination characterized by placing the at least one biological tissue on the transparent closure member (30), combining the top member (10) and the transparent closure member (30) with an interleaved fluidic seal (20);

attaching the base member (40) so that the interconnecting means (41) of the base member (40) are inserted into the openings (12) of the top member (10) and closing the slide chamber by lateral movement of the top member (10) against the transparent closure member (30).

15. The process according to claim 14, characterized in that the at least one biological tissue is placed within at least two examination chambers.

16. The slide chamber of claim 1, wherein the interconnecting means (41) is configured to create an increasing pressure (force) between the base member (40) and the top member (10) during the closing process, i.e. during lateral movement of the of the base member (40) against the top member (10).

17. The slide chamber of claim 16, wherein the increasing pressure is generated by providing at least one of a tilted shape and a compressible fluidic seal (20) on at least one of the base member (40) and the openings (12), during lateral movement of the base member (40) against the top member (10).

* * * * *